US005255665A

United States Patent [19]

Windon

[11] Patent Number: 5,255,665

[45] Date of Patent: Oct. 26, 1993

[54] POWER VENT BLOWER ASSEMBLY FOR GAS WATER HEATER

[75] Inventor: Bradley N. Windon, Hartsville, S.C.

[73] Assignee: AOS Holding Company, Wilmington, Del.

[21] Appl. No.: 732,983

[22] Filed: Jul. 19, 1991

[51] Int. Cl.[5] ..... A47J 27/00

[52] U.S. Cl. ..... 126/389; 126/215 R; 126/290; 126/312

[58] Field of Search ..... 126/389, 80, 285 R, 126/290, 293, 285 A, 312, 307 R, 307 A; 122/DIG. 7, 155.2; 110/162

[56] References Cited

U.S. PATENT DOCUMENTS

| | | | |
|---|---|---|---|
| 1,577,674 | 3/1926 | Anderson . | |
| 2,703,569 | 3/1955 | Yarbrough | 126/307 A |
| 3,158,114 | 11/1964 | Nikodem . | |
| 3,280,774 | 10/1966 | English | 110/162 |
| 4,189,295 | 2/1980 | Ramon | 431/12 |
| 4,263,890 | 4/1981 | Turko et al. | 126/295 |
| 4,266,513 | 5/1981 | Schaus | 122/155.2 |
| 4,487,137 | 12/1984 | Horvat et al. | 110/160 |
| 4,545,360 | 10/1985 | Smith et al. . | |
| 4,672,919 | 6/1987 | Staats . | |
| 4,730,598 | 3/1988 | Swinton | 126/80 |
| 4,757,802 | 7/1988 | Guzorek . | |
| 4,803,931 | 2/1989 | Carson | 126/292 |
| 5,012,793 | 5/1991 | Guzorek | 126/85 B |

*Primary Examiner*—Larry Jones

*Attorney, Agent, or Firm*—David R. Price; James Earl Lowe, Jr.

[57] ABSTRACT

A water heater comprising a tank defining a water chamber, a combustion chamber located beneath the water chamber, a flue extending through the water chamber, having a lower end communicating with the combustion chamber, and having an upper end, and a power vent blower assembly including a blower having an inlet and an outlet, and a conduit adapted to communicate with the ambient atmosphere of the water heater, the conduit including a first end communicating with the upper end of the flue, a second end communicating with the blower inlet, and structure for mixing gases from the flue with air from the ambient atmosphere of the water heater, the mixing structure including a first projection extending inwardly and in the direction of gas flow through the conduit on one side of the conduit, and a second projection extending inwardly and in the direction of gas flow through the conduit on the other side of the conduit.

28 Claims, 1 Drawing Sheet

POWER VENT BLOWER ASSEMBLY FOR GAS WATER HEATER

BACKGROUND OF THE INVENTION

The invention relates to gas water heaters, and more particularly to power vent blower assemblies for gas water heaters.

It is known to provide a gas water heater with a power vent blower assembly. The blower assembly communicates with the flue of the water heater and includes a fan or blower that forces exhaust gases into the atmosphere. See, for example, U.S. Pat. No. 4,672,919.

SUMMARY OF THE INVENTION

The invention provides a power vent blower assembly that significantly improves the efficiency of a gas water heater both during operation of the gas burner and during standby time. The invention also provides a power vent blower assembly that is easily mounted directly on the top of a water heater and that generates a limited amount of noise while the blower is operating.

More particularly, the invention provides a gas water heater comprising a combustion chamber, gas burner means located within the combustion chamber for producing hot exhaust gases, means for heating water with the hot exhaust gases, and a flue having a lower end communicating with the combustion chamber, and having an upper end adapted to communicate with the atmosphere. In one embodiment, the water heater further includes a tank defining a water chamber, and the combustion chamber is located beneath the water chamber, and the water heating means comprises the flue extending through the water chamber.

The water heater also comprises a power vent blower assembly communicating between the upper end of the flue and the atmosphere. The blower assembly includes a conventional blower having an inlet and an outlet. The outlet communicates with the atmosphere via a suitable conduit. A conventional electric motor drives the blower.

The blower assembly also includes a T-shaped conduit assembly or adaptor having a vertical leg communicating with the upper end of the flue, a horizontal leg communicating with the ambient atmosphere of the water heater, and a horizontal leg communicating with the blower inlet. Alternatively, the two horizontal legs can be viewed as a single horizontal conduit having a first end communicating with the ambient atmosphere of the water heater and a second end communicating with the blower inlet, and the vertical leg can be viewed as a vertical conduit having a lower end communicating with the upper end of the flue and an upper end communicating with the horizontal conduit intermediate the opposite ends thereof.

The first end of the horizontal conduit has therein a pivotally mounted dilution air damper which permits air flow into the horizontal conduit but substantially prevents gas flow out of the horizontal conduit.

The vertical conduit has therein, immediately above the upper end of the flue, a reduced opening or restriction having an area equal to approximately 25% of the area of the flue and equal to approximately 40% of the area of the vertical conduit. This reduced opening is preferably circular and restricts gas flow through the vertical conduit. The vertical conduit also has therein, at the upper end thereof, an arrangement for restricting gas flow through the vertical conduit and for mixing gases from the flue with air entering the first end of the horizontal conduit. This arrangement preferably includes a plate extending across the upper end of the vertical conduit and having thereon a pair of projections defining therebetween a reduced opening through which gases flow. The projections are generally planar, and both projections extend generally perpendicular to a common vertical plane having therein the longitudinal axes of the two conduits. Each projection extends inwardly toward the other and upwardly into the horizontal conduit. The projection closest to the blower inlet extends at an angle of approximately 52° with respect to a horizontal plane, and the projection farthest from the blower inlet extends at an angle of approximately 77° with respect to a horizontal plane. The projection farthest from the blower inlet is approximately twice as long as the other projection.

Gases from the flue flow upwardly through the reduced opening at the lower end of the vertical conduit and then upwardly between the projections and through the reduced opening defined by the projections. The blower draws these gases into the blower inlet, and at the same time draws clean air into the horizontal conduit at the first end of the conduit. The projections mix this air with the gases from the flue. The two reduced openings in the vertical conduit restrict gas flow through the vertical conduit. The overall effect is to increase the efficiency of the water heater.

Other features and advantages of the invention will become apparent to those skilled in the art upon review of the following detailed description, claims and drawings.

Figure 1:
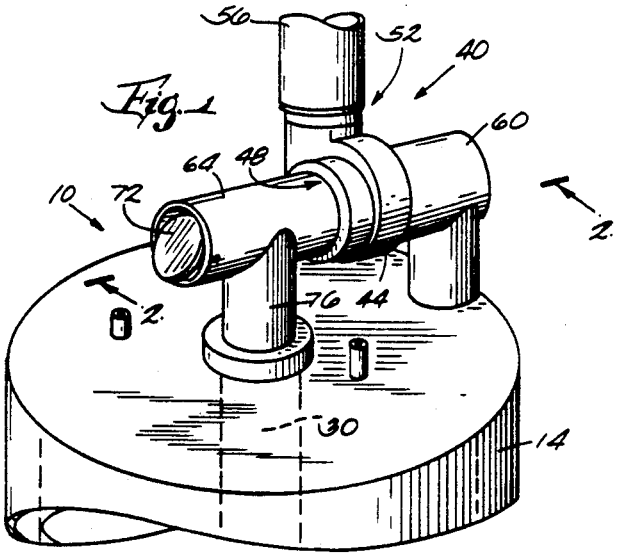
FIG. 1 is a perspective view, partially cut away, of a water heater embodying the invention.
Figure 4:
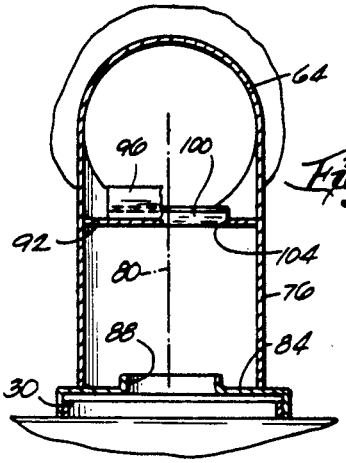
FIG. 4 is a view taken along line 4—4 in FIG. 3.

Before one embodiment of the invention is explained in detail, it is to be understood that the invention is not limited in its application to the details of the construction and the arrangements of components set forth in the following description or illustrated in the drawings. The invention is capable of other embodiments and of being practiced or being carried out in various ways. Also, it is to be understood that the phraseology and terminology used herein is for the purpose of description and should not be regarded as limiting.

DESCRIPTION OF THE PREFERRED EMBODIMENT

A gas water heater 10 embodying the invention is illustrated in the drawings. As shown in FIG. 1, in this embodiment, the water heater 10 comprises a tank 14 defining a water chamber 18, and a combustion chamber 22 located beneath the water chamber 18. The lower end of the combustion chamber 22 has therein a plurality of air inlet openings (not shown). It is important for the proper operation of the below-described power vent blower assembly that these inlet openings admit sufficient air into the combustion chamber 22. The actual size and number of the air inlet openings will vary upon the dimensions of the other components of the water heater 10.

A gas burner 26 is located in the combustion chamber 22. The water heater 10 also comprises a flue 30 extending through the water chamber 18, having a lower end communicating with the combustion chamber 22, and having an upper end. The water heater 10 as thus far described is conventional.

The water heater 10 also comprises a power vent blower assembly 40 communicating with the upper end of the flue 30. The blower assembly 40 includes a conventional blower 44 having an inlet 48 and an outlet 52. The outlet 52 communicates with the atmosphere via a suitable conduit 56. A conventional electric motor 60 powers the blower 44. An electrical circuit (not shown) of the water heater 10 includes conventional means for permitting operation of the gas burner 26 only when the motor 60, and thus of the blower 44, is operating.

Figure 2:
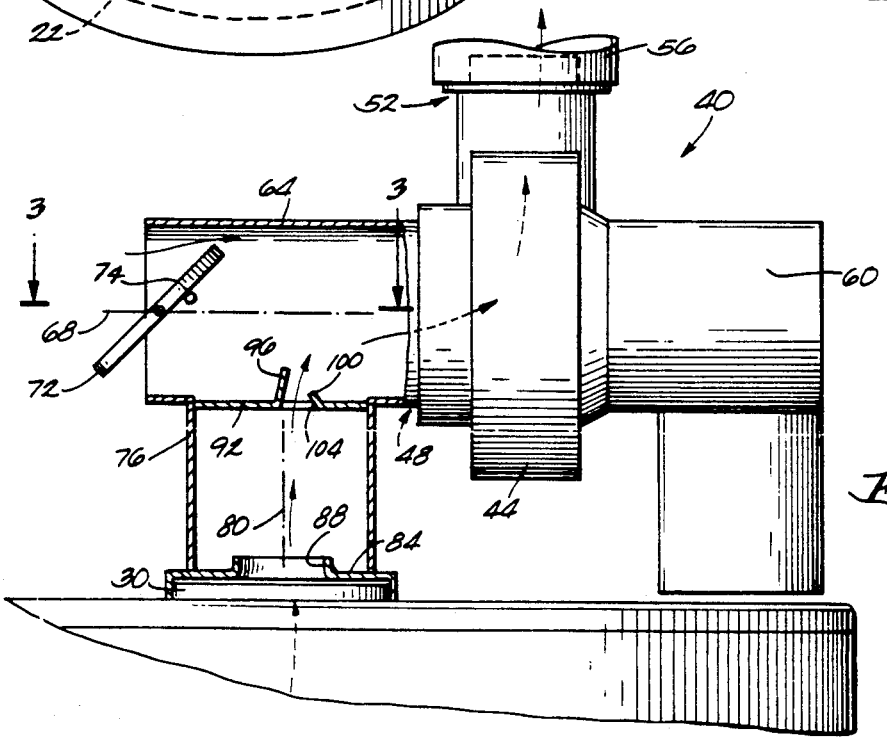
FIG. 2 is a view taken along line 2—2 in FIG. 1.

The blower assembly 40 also includes (see FIG. 2) a horizontal conduit 64 extending along a generally horizontal axis 68. The conduit 64 has a first or left end communicating with the ambient atmosphere of the water heater 10, and a second or right end communicating with the blower inlet 48. Pivotally mounted in the left end of the conduit 64 is a dilution air damper 72 which is weighted so that the dilution air damper 72 is normally in a position closing the left end of the conduit 64. During operation of the blower 44, the suction created in the conduit 64 by the blower 44 is sufficient to pivot the dilution air damper 72 to an open position wherein the dilution air damper 72 permits air flow into the conduit 64. The dilution air damper 72 thus permits air flow into the conduit 64 during blower operation and substantially prevents gas flow out of the conduit 64 when the blower 44 is not operating. The amount of pivotal movement of the damper 72 is limited by a stop 74 to restrict the amount of dilution air which can enter the blower assembly 40 so that a proper amount of suction is applied to the upper end of the flue 30. The amount of dilution air entering through the damper 72 and the amount of combustion air entering through the combustion chamber air inlets (not shown) is controlled so that the efficiency of the water heater is optimized while at the same time limiting the temperature of the exhaust gases exiting the blower assembly. In the preferred embodiment, PVC is used as the material for the exhaust conduit 56, and the gases exiting the blower assembly are limited to less than 157 degrees Fahrenheit.

The blower assembly 40 also includes a vertical conduit 76 extending along a generally vertical axis 80 intersecting the axis 68 of the conduit 64. The vertical conduit 76 has a lower end communicating with the upper end of the flue 30 and has an upper end communicating with the horizontal conduit 64 intermediate the opposite ends thereof.

The blower assembly 40 further includes means adjacent the lower end of the vertical conduit 76 and adjacent the upper end of the flue 30 for restricting gas flow through the vertical conduit 76. While various suitable means can be employed, in the illustrated construction, such means includes a substantially horizontal plate 84 extending across the lower end of the vertical conduit 76 and having therein a reduced opening 88. The opening 88 is preferably circular and has an area approximately equal to 25% of the area of the flue 30 and approximately equal to 40% of the area of the vertical conduit 76.

Figure 3:
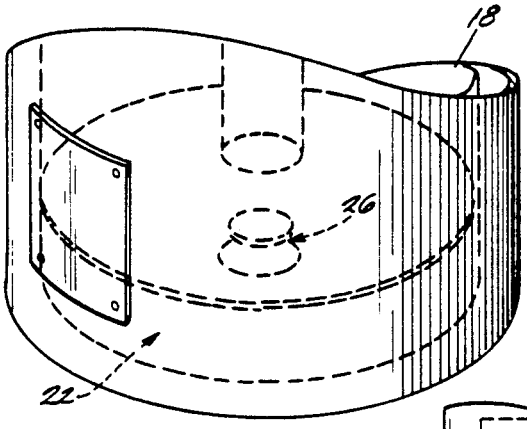
FIG. 3 is a view taken along line 3—3 in FIG. 2.
Figure 3:
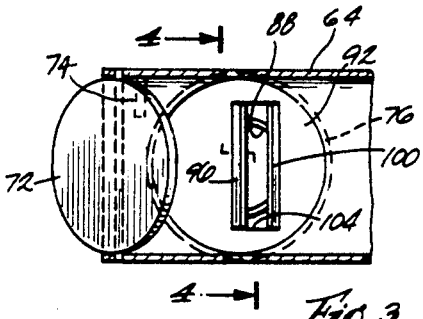

The blower assembly 40 also includes means adjacent the upper end of the vertical conduit 76 for mixing gases from the flue 30 with air from the ambient atmosphere of the water heater 10 and for restricting gas flow through the vertical conduit 76. While various suitable means can be employed, in the illustrated construction, such means includes a substantially horizontal plate 92 extending across the upper end of the vertical conduit 76. The plate 92 has thereon a first or left projection 96 and a second or right projection 100. The projections 96 and 100 define therebetween a generally rectangular reduced opening 104, which, as shown in FIG. 3, is preferably slightly off-center, in the direction toward the blower 44, with respect to the conduit 76. The left projection 96 extends inwardly and upwardly (or in the direction of gas flow through the conduit 76) on the left side of the conduit 76, and the right projection 100 extends inwardly and upwardly on the right side of the conduit 76. Thus, the left projection 96 is located closest to or adjacent the left end of the horizontal conduit 64, and the right projection 100 is located closest to or adjacent the right end of the horizontal conduit 64. Preferably, both projections 96 and 100 are generally planar and extend perpendicular to a vertical plane having therein the conduit axes 68 and 80. The left projection 96 extends at an angle of approximately 77° with respect to a plane perpendicular to the conduit axis 80 (i.e., a horizontal plane), and the right projection 100 extends at an angle of approximately 52° with respect to the same plane. The left projection 96 is preferably approximately twice as long as the right projection 100, and the sum of the lengths of the projections 96 and 100 is approximately equal to the width (the dimension from left to right in FIG. 2) of the opening 104.

The plate 92, the projections 96 and 100 and the opening 104 are preferably formed from a solid plate as follows.

First, the solid plate is cut in the shape of an H to form a pair of inwardly extending, coplanar tabs separated by the cross member of the H. Next, one of the tabs is bent upwardly to form the left projection 96, and the other tab is bent upwardly to form the right projection 100. The space previously occupied by the tabs forms the reduced opening 104.

When the gas burner 26 is operating, the electrical circuit of the water heater 10 activates the motor 60 and thereby activates the blower 44. The blower 44 draws air into the left end of the horizontal conduit 64 and also draws gases upwardly through the vertical conduit 76. The two reduced openings 88 and 104 restrict gas flow through the vertical conduit 76. The projections 96 and 100 mix the flue gases with air entering the left end of the horizontal conduit 64. The end result is improved efficiency of the water heater 10 both during operation of the gas burner 26 and during standby time. Substantially no gases escape from the water heater 10 during standby time. Also, the power vent blower assembly 40 is easily mounted directly on the top of the water heater 10, and the blower assembly 40 generates a limited amount of noise while the blower 44 is operating.

Various features of the invention are set forth in the following claims.

I claim:

1. A water heater comprising a combustion chamber, gas burner means located within the combustion chamber for producing hot exhaust gases, means for heating water with the hot exhaust gases, a flue having a lower end communication with said combustion chamber, and having an upper end, and a power vent blower assembly including a conduit having a first end communicating with said upper end of said flue, and having a second end, a blower having an inlet communicating with said second end of said conduit, and having an outlet adapted to communicate with the atmosphere, first means adjacent said upper end of said flue for restricting gas flow through said conduit, second means adjacent but spaced from said first means for restricting gas flow through said conduit, and means between said second means and said blower inlet for mixing gases from said flue with air from the ambient atmosphere of said water heater.

2. A water heater as set forth in claim 1 wherein said restricting means includes a reduced opening having an area equal to approximately 25% of the area of said flue.

3. A water heater as set forth in claim 2 wherein said reduced opening has an area approximately equal to 40% of the area of said conduit.

4. A water heater as set forth in claim 2 wherein said reduced opening is generally circular.

5. A water heater as set forth in claim 1 and further including a tank defining a water chamber, and said combustion chamber is located beneath said water chamber, and wherein said water heating means comprises said flue extending through said water chamber.

6. A water heater as set forth in claim 1 wherein said power vent blower assembly further includes dilution air means between said second restricting means and said blower for mixing gases from said flue with air from the ambient atmosphere of said heater, and a dilution air damper in said dilution air means for closing said dilution air means when said blower is off and for opening said dilution air means when said blower is on.

7. A water heater comprising a combustion chamber, gas burner means located within the combustion chamber for producing hot exhaust gases, means for heating water with the hot exhaust gases, a flue having a lower end communicating with said combustion chamber, and having an upper end, and a power vent blower assembly including a blower having an inlet and an outlet, and a conduit adapted to communicate with the ambient atmosphere of said water heater, said conduit including a first end communicating with said upper end of said flue, a second end communicating with said blower inlet, and means for mixing gases from said flue with air from the ambient atmosphere of said water heater, said mixing means including a first projection extending inwardly toward the center of said conduit and in the direction of gas flow through said conduit on one side of said conduit, and a second projection extending inwardly toward the center of said conduit and in the direction of gas flow through said conduit on the other side of said conduit.

8. A water heater as set forth in claim 7 wherein said flue extends along an axis, and wherein said mixing means also includes a plate which has therein an opening, which has thereon said projections, and which extends generally perpendicular to said flue axis.

9. A water heater as set forth in claim 8 wherein said first projection has a length, wherein said second projection has a length, and wherein said opening has a width approximately equal to the sum of said lengths of said projections.

10. A water heater as set forth in claim 8 wherein said plate, said projections, and said opening are formed by providing a plate, providing in said plate an H-shaped cut so as to form coplanar tabs extending inwardly toward the center of said conduit, bending one of said tabs to form said first projection, bending the other of said tabs to form said second projection, and extending said plate across said conduit.

11. A water heater as set forth in claim 7 wherein said conduit extends along an axis, and wherein said projections are generally planar and extend generally perpendicular to a common plane including said axis.

12. A water heater as set forth in claim 11 wherein said first projection extends at an angle of approximately 77° with respect to a second plane perpendicular to said axis, wherein said second projection extends at an angle of approximately 52° with respect to said second plane, and wherein said first projection is approximately twice as long as said second projection.

13. A water heater as set forth in claim 7 wherein said mixing means also restricts gas flow.

14. A water heater as set forth in claim 7 and further including a tank defining a water chamber, and said combustion chamber is located beneath said water chamber, and wherein said water heating means comprises said flue extending through said water chamber.

15. A water heater as set forth in claim 7 wherein said conduit is adapted to communicate with the ambient atmosphere immediately surrounding said water heater.

16. A water heater comprising a combustion chamber, gas burner means located within the combustion chamber for producing hot exhaust gases, means for heating water with the hot exhaust gases, a flue having a lower end communicating with said combustion chamber, and having an upper end, and a power vent blower assembly including a horizontal conduit extending along a generally horizontal axis, having a first end adapted to communicate with the ambient atmosphere of said water heater, and having a second end, a blower having an inlet communicating with said second end of said horizontal conduit, and having an outlet, a vertical conduit extending along a generally vertical axis, having a lower end communicating with said upper end of said flue, and having an upper end communicating with said horizontal conduit intermediate said first and second ends of said horizontal conduit, means located adjacent said lower end of said vertical conduit for restricting gas flow from said flue through said vertical conduit, and means located adjacent said upper end of said vertical conduit for mixing gases from said flue with air from the ambient atmosphere of said water heater.

17. A water heater as set forth in claim 16 wherein said restricting means includes a substantially horizontal plate extending across said vertical conduit and having therein a reduced opening.

18. A water heater as set forth in claim 13 wherein said mixing means includes means defining an opening communicating with said vertical conduit, a first projection extending upwardly and inwardly on one side of said opening, and a second projection extending upwardly and inwardly on the other side of said opening.

19. A water heater as set forth in claim 18 wherein said projections are generally planar and extend generally perpendicular to a common vertical plane including said horizontal axis.

20. A water heater as set forth in claim 16 wherein said mixing means includes a substantially horizontal plate extending across said vertical conduit, having therein a reduced opening, and having thereon a first planar projection extending upwardly on one side of said opening and generally perpendicular to a vertical plane including said horizontal axis, and a second generally planar projection extending upwardly on the other side of said opening and generally perpendicular to said plane.

21. A water heater as set forth in claim 20 wherein said first projection extends upwardly and toward said second projection at an angle of approximately 77° with respect to said plate, and wherein said second projection extends upwardly and toward said first projection at an angle of approximately 52° with respect to said plate.

22. A water heater as set forth in claim 20 wherein said first projection is approximately twice as long as said second projection and is located adjacent said first end of said horizontal conduit, and wherein said second projection is located adjacent said second end of said horizontal conduit.

23. A water heater as set forth in claim 16 and further including a tank defining a water chamber, and said combustion chamber is located beneath said water chamber, and wherein said water heating means comprises said flue extending through said water chamber.

24. A water heater as set forth in claim 16 wherein said power vent blower assembly further includes a dilution air damper in said first end of said horizontal conduit.

25. A water heater as set forth in claim 16 wherein said first end of said horizontal conduit is adapted to communicate with the ambient atmosphere immediately surrounding said water heater.

26. A heater comprising a combustion chamber, gas burner means located within the combustion chamber for producing hot exhaust gases, heat exchanger means for heating a fluid with the hot exhaust gases, a flue having a lower end communication with said combustion chamber, and having an upper end, and a power vent blower assembly including a conduit having a first end communicating with said upper end of said flue, and having a second end, a blower having an inlet communicating with said second end of said conduit, and having an outlet adapted to communicate with the atmosphere, first means adjacent said upper end of said flue for restricting gas flow through said conduit, second means adjacent but spaced from said first means for restricting gas flow through said conduit, and means between said second means and said blower inlet for mixing gases from said flue with air from the ambient atmosphere of said heater.

27. A heater comprising a combustion chamber, gas burner means located within the combustion chamber for producing hot exhaust gases, heat exchanger means for heating fluid with the hot exhaust gases, a flue having a lower end communicating with said combustion chamber, and having an upper end, and a power vent blower assembly including a blower having an inlet and an outlet, and a conduit adapted to communicate with the ambient atmosphere of said water heater, said conduit including a first end communicating with said upper end of said flue, a second end communicating with said blower inlet, and means for mixing gases from said flue with air from the ambient atmosphere of said water heater, said mixing means including a first projection extending inwardly toward the center of said conduit and in the direction of gas flow through said conduit on one side of said conduit, and a second projection extending inwardly toward the center of said conduit and in the direction of gas flow through said conduit on the other side of said conduit.

28. A heater comprising a combustion chamber, gas burner means located within the combustion chamber for producing hot exhaust gases, heat exchanger means for heating fluid with the hot exhaust gases, a flue having a lower end communicating with said combustion chamber, and having an upper end, and a power vent blower assembly including a horizontal conduit extending along a generally horizontal axis, having a first end adapted to communicate with the ambient atmosphere of said water heater, and having a second end, a blower having an inlet communicating with said second end of said horizontal conduit, and having an outlet, a vertical conduit extending along a generally vertical axis, having a lower end communicating with said upper end of said flue, and having an upper end communicating with said horizontal conduit intermediate said first and second ends of said horizontal conduit, means located adjacent said lower end of said vertical conduit for restricting gas flow through said vertical conduit, and means located adjacent said upper end of said vertical conduit for mixing gases from said flue with air from the ambient atmosphere of said water heater.

* * * * *